United States Patent [19]

Buchmuller et al.

[11] Patent Number: 4,739,625

[45] Date of Patent: Apr. 26, 1988

[54] DEVICE FOR FREEZING FOODSTUFFS INSIDE A TRAY CART

[75] Inventors: Jurgen Buchmuller, Krefeld; Wolfgang Hoffmanns, Willich, both of Fed. Rep. of Germany

[73] Assignee: Messer Griesheim GmbH, Fed. Rep. of Germany

[21] Appl. No.: 28,114

[22] Filed: Mar. 19, 1987

[30] Foreign Application Priority Data

Mar. 27, 1986 [DE] Fed. Rep. of Germany ..... 3610563

[51] Int. Cl.[4] ..... F25B 1/00

[52] U.S. Cl. ..... 62/209; 62/373; 165/48.1; 165/919

[58] Field of Search ..... 62/64, 62, 209, 373, 62/376, 384; 165/48.1, 918, 919

[56] References Cited

U.S. PATENT DOCUMENTS

| | | | |
|---|---|---|---|
| 3,905,206 | 9/1975 | Deubel et al. | 62/373 |
| 4,107,937 | 8/1978 | Chmiel | 62/373 |
| 4,356,707 | 11/1982 | Tyree, Jr. et al. | 62/384 |
| 4,380,908 | 4/1983 | Crabb, Jr. | 62/64 |
| 4,407,136 | 10/1983 | de Kanter | 62/374 |

*Primary Examiner*—Ronald C. Capossela
*Attorney, Agent, or Firm*—Connolly & Hutz

[57] ABSTRACT

A device for freezing foodstuffs on a tray cart includes a liquid cryogenic refrigerant spraying system for each side of the cart. The spraying systems are activated by reversible magnet valves. Rotary fans circulate the vaporized refrigerant. The fans are reversibly rotated for drawing in or blowing out the vaporized refrigerant across the cart shelves.

2 Claims, 1 Drawing Sheet

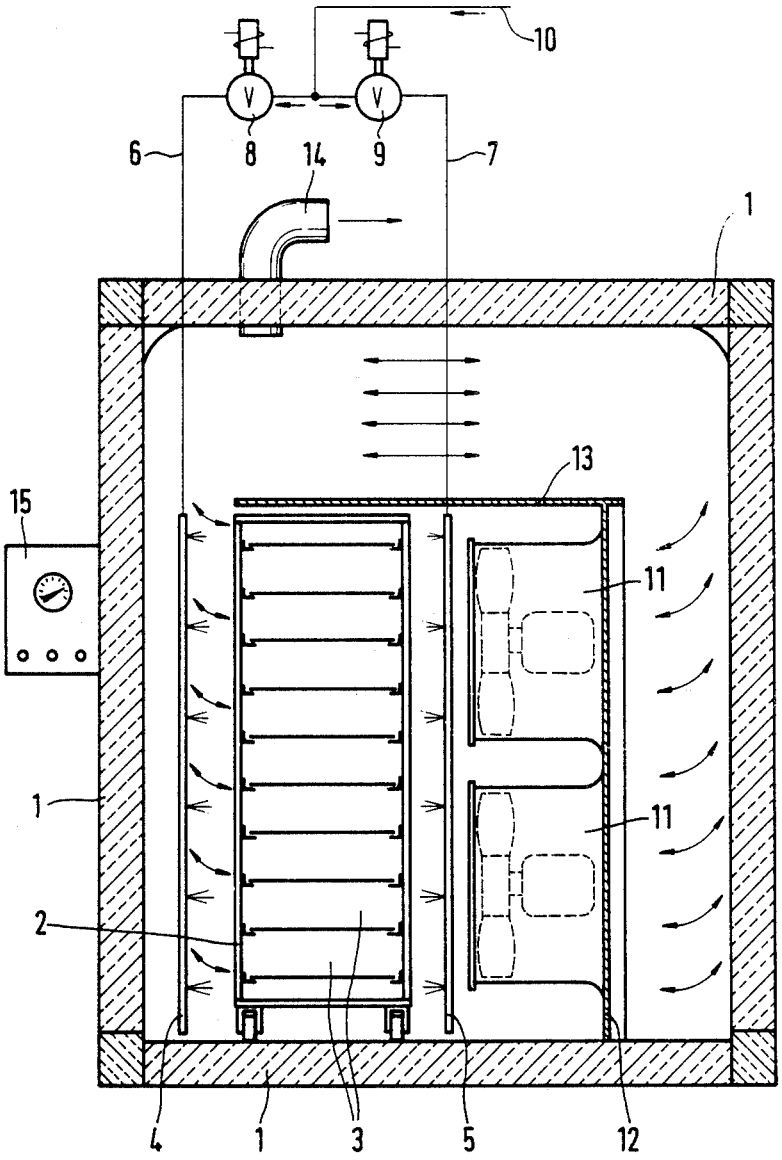
10
V
V
8
9
6
7
14
1
13
15
11
11
1
2
4
1
3
5
12

DEVICE FOR FREEZING FOODSTUFFS INSIDE A TRAY CART

BACKGROUND OF INVENTION

Foodstuffs on a tray cart are frozen solid by being stored in an insulated compartment and there exposed to an immediate heat exchange which takes place with a cryogenic refrigerant that is to be introduced. The refrigerant is usually liquid nitrogen or liquid carbon dioxide. This refrigerant is sprayed into the insulated compartment by means of a spraying system, where it develops a gaseous constitution upon contact with the foodstuffs which are to be supercooled, or, frozen. The cold refrigerant, which from this point is gaseous, is circulated by one or more fans, penetrates over and over again the various shelves of the storage cart. Finally, it is drawn off from the insulated compartment through an exhaust. It is unavoidable that the food provisions that are positioned closer to the spraying system are cooled more intensively than those farther away. Because of the irregular and uneven exposure to introduction of the refrigerant gas, there is consequently a variation in the refrigeration and freezing conditions where individual products are concerned. This situation is especially undesirable in the case of perishable foodstuffs.

SUMMARY OF THE INVENTION

An object of this invention is to provide an apparatus for the freezing of foodstuffs on a tray cart which would allow for even distribution of the refrigerant gas on each individual shelf of the tray cart stocked with foodstuffs.

In accordance with this invention a liquid cryogenic refrigerant spraying system is provided for each side of the cart activated by reversible magnet valves. Reversibly rotatable fans either draw in or blow out the vaporized refrigerant across the cart.

The mutual introduction of the freezable materials according to the device of the present invention has the advantage of not only cooling and then freezing the foodstuffs more evenly and carefully, but it also reduces the freezing time and lowers the amount of refrigerant necessary.

THE DRAWINGS

The single FIGURE illustrates a cross-sectional view of the operational example of the invention.

DETAILED DESCRIPTION

The device as presented in the drawing consists of an insulated compartment 1, which possesses also an insulated door, not shown here, through which there can be loaded a tray cart 2. On the individual shelves 3, of the tray cart are to be found the foodstuffs to be frozen. In accordance with the invention, a spraying system 4, 5, is to be installed on each of the oblong sides of the tray cart, 2. The spraying systems 4, 5, are connected by means of conduits 6, 7, and magnet valves 8, 9, by means of a conduit, 10, to a reservoir, not shown, for the liquid nitrogen. In front of one of the oblong sides of the tray cart, 2, there are two fans, 11, for the purpose of circulating the sprayed-in and vaporized liquid nitrogen. The fans, 11 are mounted on a frame, 12, from which there extends a baffle-plate, 13, over the fans, 11, and the tray cart, 2. The baffle-plate, 13, causes a concentrated stream of gas through the shelves, 3, of the tray cart, 2.

According to the invention, the direction of rotation and thus the propelling direction of the fans, 11, is reversible. The emanating gas stream, not shown, is represented by arrows. The heated refrigerant then leaves the insulated compartment, 1, by way of the exhaust, or outlet, 14. On one wall of the insulated compartment, 1, there is control panel, 15.

The course of the freezing process, using the device presented by the invention, is described as follows.

First, the interval of freezing and the timing of the spraying for the spraying systems 4, 5, are to be regulated on the control panel, 15. These selective values depend, of course, on the kind of foods to be frozen. Similarly, the selective freezing temperature is regulable on the control panel. The spraying time takes up, let us say, 5 min. As soon as the settings are completed on the control panel, the magnent valve, 8, opens, and liquid nitrogen flows through the conduit, 6, and through the spraying system, 4, into the interior of the insulated compartment, 1. The fans, 11, would be, at the same time, so regulated, in co-ordination with the opening and closing of the magnet valves 8, 9, that they will draw out and circulate thoroughly through the valves, 3, of the tray cart, 2 the nitrogen which is vaporizing and emerging from the spraying system, 4. A certain amount of gaseous nitrogen, corresponding in volume to that which is being sprayed in, will escape continuously through the exhaust, 14. After 5 min., the magnet valve, 8, is closed, and magnet valve, 9, opens. At this point, the liquid nitrogen enters through the conduit, 7, and the spraying system, 5, into the interior of the insulated compartment, 1, and becomes introduced to the other oblong side of the tray cart, 2. At the same time, the rotating action of the fans, 11, is reversed, so that, from this point, they will blow and circulate the sprayed and vaporized nitrogen through the shelves 3, of the tray cart, 2. After 5 min., the rotation is once again reversed, and the liquid nitrogen sprayed in through the magnet valve, 8, the conduit, 6, and the spraying system, 4. The process is repeated in accordance with the values which have been registered at the control panel, 15, until the freezing process is completed according to the desired manner. It is, of course, not required that, during a 5-minute period, liquid nitrogen by sprayed in constantly from one of the two spraying systems, 4, 5. The number and arrangement of the fans, 11, should be so selected that a maximumly uniform flow of gas establishes itself through the shelves, 3, of the tray cart, 2. For tray carts of usual size, it seems the rule that two fans, 11, one above the other, will suffice.

The device of the present invention serves principally to freeze foodstuffs solid, but it is discernible similarly that it may be put into operation for simple refrigeration of food products.

SUMMARY

Foodstuffs which are stocked on a tray cart: 2, are frozen through being sprayed inside an insulated compartment 1 with a liquid cryogenic refrigerant, usually nitrogen or carbon dioxide. The vaporized refrigerant is circulated by fans, and finally removed from the insulated compartment by an exhaust 14. The introduction of the refrigerant to the food products is irregular, i.e., uneven, during this process, because those food items which are closer to the spraying system are cooled to a far lower temperature than are items that are situated farther away. For the purpose of uniformizing the introduction of the refrigerant, a spraying system 4, 5, is installed on each of the two oblong sides of the tray cart. These two spraying systems are furnished alternately with refrigerant. The rotating blade-fans 11 are located on one oblong side of the tray cart, and are equipped with a reversible rotation and propelling direction. Their direction of turn is co-ordinated with the introductory spraying system to the extent that the vaporizing refrigerant that is emerging will be drawn, or blow across the shelves of the tray cart.

What is claimed is:

1. In a device for freezing foodstuffs on shelves in a tray cart by means of a liquid cryogenic refrigerant, said device comprising an insulated compartment, a tray cart in said compartment, a spraying system in said compartment for spraying the refrigerant in said compartment, at least one fan in said compartment for circulating the vaporized refrigerant, and an outlet in said compartment for discharging the vaporized refrigerant, the improvement being in that said tray cart having oblong sides, said spraying system being provided for each of said oblong sides, reversible magnet valve means in said compartment for activating each of said spraying systems and alternately admitting the refrigerant, said fans being located in said compartment to comprise means to circulate the vaporized refrigerant in front of a given one of said oblong sides of said tray cart, said fans being capable of reversible rotation direction, and the direction of rotation of said fans being dependent on the activation of said spraying system whereby the refrigerant emerges from said spraying system in a state of rapid vaporization and is selectively drawn and blow across said shelves of said tray cart.

2. Device according to claim 1, wherein said fans comprise two rotary fans, and one of said of said fans being located above the other of said fans.

* * * * *